US010315743B1

(12) United States Patent
Maresh

(10) Patent No.: US 10,315,743 B1
(45) **Date of Patent: *Jun. 11, 2019**

(54) OSCILLATING FIN PROPULSION ASSEMBLY

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/613,250

(22) Filed: Jun. 4, 2017

Related U.S. Application Data

(63) Continuation of application No. 14/944,205, filed on Nov. 17, 2015, now Pat. No. 9,669,913.

(60) Provisional application No. 62/123,446, filed on Nov. 17, 2014, provisional application No. 62/123,805, filed on Nov. 29, 2014, provisional application No. 62/125,283, filed on Jan. 16, 2015, provisional application No. 62/125,874, filed on Feb. 2, 2015, provisional application No. 62/177,008, filed on Mar. 3, 2015, provisional application No. 62/177,786, filed on Mar. 23, 2015, provisional application No. 62/178,201, filed on Apr. 2, 2015.

(51) Int. Cl.
*B63H 1/36* (2006.01)
*B63H 16/08* (2006.01)
*B63H 5/00* (2006.01)

(52) U.S. Cl.
CPC ..... *B63H 1/36* (2013.01); *B63H 5/00* (2013.01); *B63H 16/08* (2013.01)

(58) Field of Classification Search
CPC ... B63H 1/32; B63H 1/36; B63H 5/00; B63H 2005/00
USPC ..... 440/13–15
See application file for complete search history.

(56) References Cited

U.S. PATENT DOCUMENTS

| | | | | |
|---|---|---|---|---|
| 7,637,791 | B2 * | 12/2009 | Ketterman | B63H 1/36 440/13 |
| 9,669,913 | B1 * | 6/2017 | Maresh | B63H 1/36 |
| 9,676,459 | B1 * | 6/2017 | Maresh | B63H 5/00 |
| 2009/0311926 | A1 * | 12/2009 | Ketterman | B63H 1/36 440/13 |

* cited by examiner

*Primary Examiner* — Daniel V Venne
(74) *Attorney, Agent, or Firm* — Nick A Nichols, Jr.

(57) ABSTRACT

A water propulsion assembly operatively connected to a watercraft moving on or through a body of water, may produce a propulsive force by sweeping fins in an oscillating motion in a generally transverse direction relative to a longitudinal axis of the watercraft. The fins may be rotatable about a first axis coplanar to the center longitudinal axis of the watercraft. Drive members rotatable about a second axis that is canted relative to the first axis may be operatively connected to the fins. The oscillatory motion of the fins may be controlled by torque applied at the canted second axis by reciprocating the drive members in a plane generally parallel to the center longitudinal axis of the watercraft. The oscillating fins may provide a propulsive force during both oscillating directions of the fins as they sweep back and forth.

8 Claims, 5 Drawing Sheets

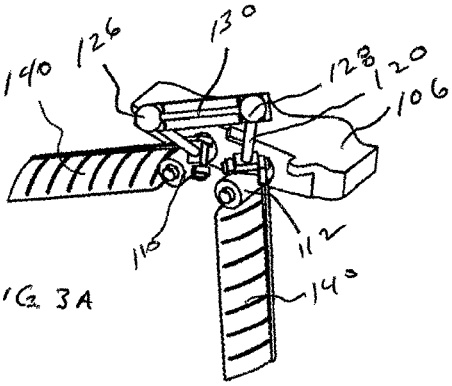
FIG. 3A
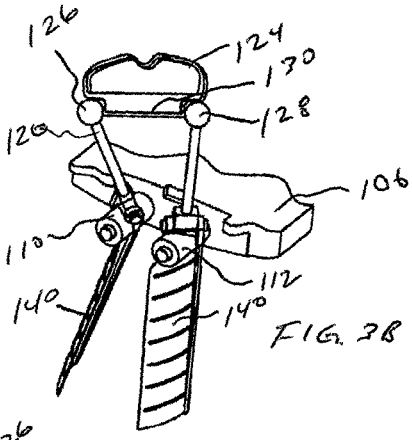
FIG. 3B
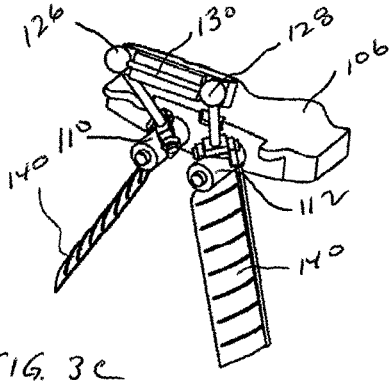
FIG. 3C
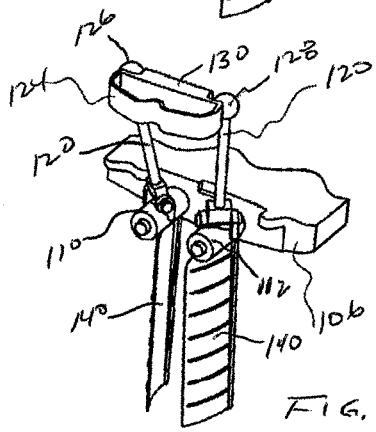
FIG. 3D
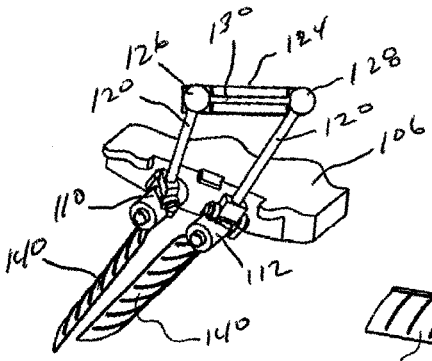
FIG. 3G
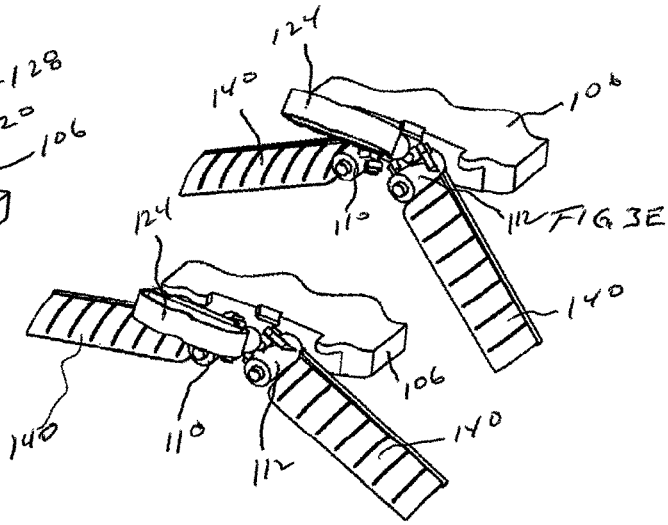
FIG. 3E
FIG. 3F

OSCILLATING FIN PROPULSION ASSEMBLY

CROSS-REFERENCE TO RELATED APPLICATION

This application is a continuation of U.S. Non-Provisional application Ser. No. 14/944,205, filed Nov. 17, 2015, now U.S. Pat. No. 9,669,913, which claims the benefit of U.S. Provisional Application Ser. No. 62/123,446, filed Nov. 17, 2014, U.S. Provisional Application Ser. No. 62/123,805, filed Nov. 29, 2014, U.S. Provisional Application Ser. No. 62/125,283, filed Jan. 16, 2015, U.S. Provisional Application Ser. No. 62/125,874, filed Feb. 2, 2015, U.S. Provisional Application Ser. No. 62/177,008, filed Mar. 3, 2015, U.S. Provisional Application Ser. No. 62/177,786, filed Mar. 23, 2015, and U.S. Provisional Application Ser. No. 62/178,201, filed Apr. 2, 2015, which applications are incorporated herein by reference in their entirety.

BACKGROUND

The present invention relates to a water propulsion system, and more generally, to a thrust generating oscillating fin propulsion assembly adapted for underwater propulsion.

Pedal operated propulsion apparatus, such as a foot operated paddle boat described in U.S. Pat. No. 3,095,850, are known in the art. Other pedal operated means linking rotatable pedals to a propeller have been proposed. Some have looked to the swimming motion of sea creatures to design mechanically powered propulsion systems. Generally speaking, the swimming behavior of sea creatures may be classified into two distinct modes of motion: middle fin motion or median and paired fin (MPF) mode and tail fin or body and-caudal fin (BCF) mode, based upon the body structures involved in thrust production. Within each of these classifications, there are numerous swimming modes along a spectrum of behaviors from purely undulatory to entirely oscillatory modes. In undulatory swimming modes thrust is produced by wave-like movements of the propulsive structure (usually a fin or the whole body). Oscillatory modes, on the other hand, are characterized by thrust production from a swiveling of the propulsive structure at the attachment point without any wave-like motion. A penguin or a turtle, for example, may be considered to have movements generally consistent with an oscillatory mode of propulsion.

In 1997, Massachusetts Institute of Technology (MIT) researchers reported that a propulsion system that utilized two oscillating blades of MPF mode produced thrust by sweeping back and forth in opposite directions had achieved efficiencies of 87%, compared to 70% efficiencies for conventional watercraft. A 12-foot scale model of the MIT Proteus "penguin boat" was capable of moving as fast as conventional propeller driven watercraft. Another MIT propulsion system referred to as a "Robotuna," utilized a tail in BCF mode propulsion patterned after a blue fin tuna, achieved efficiencies of 85%. Based upon limited studies, higher efficiencies of 87% (and by some reports 90-95% efficiency) may be possible with oscillatory MPF mode propulsion that may enable relatively long distances of human powered propulsion being achieved both on and under the water surface.

U.S. Pat. No. 6,022,249 describes a kayak having a propulsion system that extends below the water line. The propulsion system includes a pair of flappers in series, each adapted to oscillate through an arcuate path in a generally transverse direction with respect to the central longitudinal dimension of the kayak.

SUMMARY

In an oscillating fin propulsion assembly operatively connected to a watercraft moving on or through a body of water, a propulsive force may be produced by a pair of fins adapted to sweep back and forth in a generally transverse direction relative to the longitudinal axis of the watercraft. The fins may be rotatable about a first axis coplanar to the center longitudinal axis of the watercraft. Drive members rotatable about a second axis that is canted relative to the first axis may be operatively connected to the fins. The oscillatory motion of the fins may be controlled by torque applied at the canted second axis by reciprocating the drive members. The oscillating fins may provide a propulsive force to propel the watercraft longitudinally forward during both oscillating directions of the fins as they sweep back and forth.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIGS. 3A-3G are perspective views illustrating multiple positions of the fins upon actuation of the drive handles of the oscillating fin propulsion assembly shown in FIG. 1.

DETAILED DESCRIPTION

Figure 1:
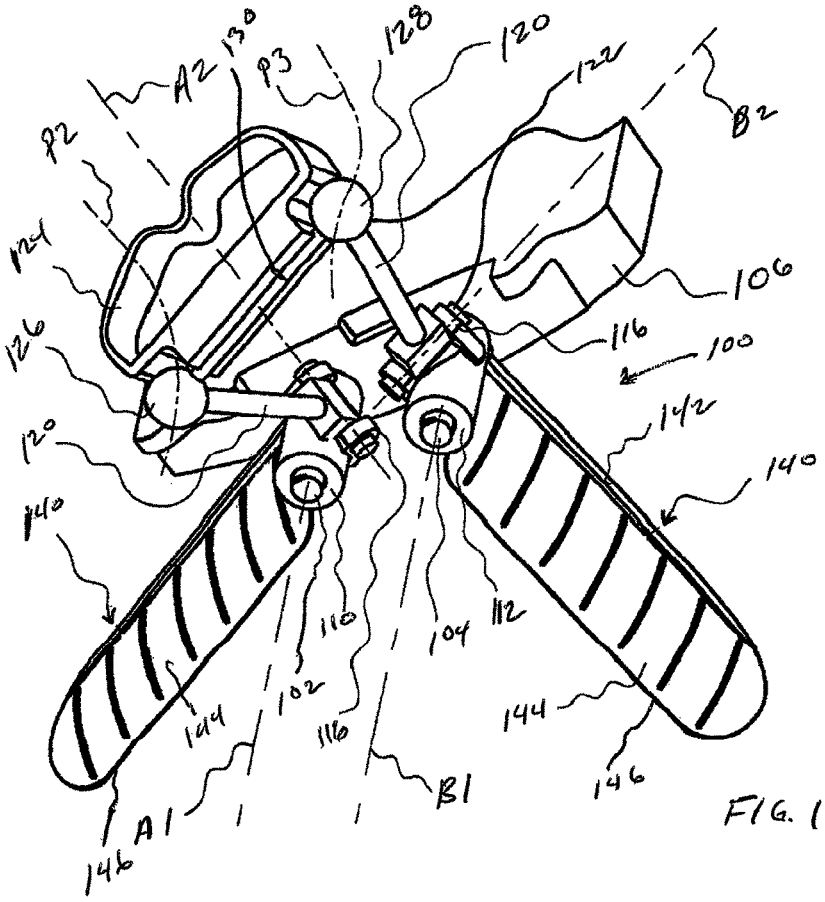
FIG. 1 is a partially broken away perspective view of an oscillating fin propulsion assembly mounted to a rear region of a floatation device.

Referring first to FIG. 1, a water floatation device, such as a swim board, a paddle board, a surfboard and the like is illustrated outfitted with an oscillating fin propulsion system generally identified by the reference numeral 100. The propulsion assembly 100 may include transversely spaced apart left and right longitudinal shafts 102 and 104 rigidly secured to a rear region of a water floatation device 106. Alternatively, the shafts 102, 104 may be fixed at central or forward regions of the floatation device 106. The shafts 102, 104 may include laterally extending members (not shown in the drawings) in order to distribute forces acting on the shafts 102, 104 more broadly within the core of the floatation device 106. When utilizing wood or other solid board material for fabrication of the floatation device 106, holes may be bored into the floatation device 106 and the shafts 102, 104 glued in place. In yet another fabrication example, the floatation device 106 may be blow molded having a foam interior. Support for the shafts 102, 104 may be at an edge region of the blow molded shell.

Left and right mounting blocks, hereinafter referred to as canted journal blocks 110 and 112 may be rotatably secured to respective shafts 102, 104. The canted journal blocks 110, 112 may include a longitudinal borehole 114, better shown in FIG. 2, for receiving a respective shaft 102, 104 therethrough. The canted journal blocks 110, 112 may include first axes A1 and B1, respectively. Each axis A1, B1 define a respective first longitudinal axis, coincident with the center longitudinal axis of the boreholes 114. The axes A1 and B1 may extend parallel to the longitudinal center axis of the floatation device 106.

Figure 2:
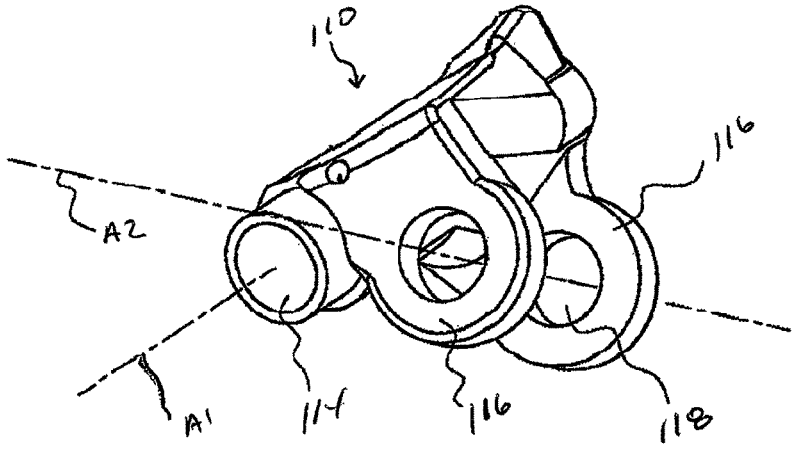
FIG. 2 is a perspective view of a canted journal block of the oscillating fin propulsion assembly shown in FIG. 1.

Referring still to FIGS. 1 and 2, each canted journal block 110, 112 may define a journal body having a pair of spaced apart upstanding tabs 116. The tabs 116 may include through holes 118 that are axially aligned with one another. Lower distal ends of elongated drive handles 120 may be rotatably secured between the tabs 116 of each canted journal block 110, 112 by a shaft 122. The lower distal end of the drive handles 120 may comprise a hollow tube fixed to or integrally formed with the drive handles 120 extending transversely to the longitudinal axis of the drive handles 120.

The left and right canted journal block 110, 112, may further include second axes A2 and B2 defining a respective second longitudinal axis passing through the center of axially aligned through holes 118 of the tabs 116. The second axes A2, B2 may be displaced and canted relative to the first axes A1, B1 of the canted journal block 110, 112. The first axes A1, B1 and the second axes A2, B2 of the left and right canted journal blocks 110, 112 may be angularly displaced from one another by a canted angle of about ten (10°) to about eighty (80°) degrees. Preferably, the canted angle may be about forty-five (45°) degrees. The canted angle may be directed from the front to the rear in an inwardly direction, or alternatively, the canted angle may be directed from the front to the rear in an outwardly direction.

In the drawings, the illustrated canted angle is forty-five (45°) degrees. Adjusting the canted angle to more or less than forty-five (45°) degrees will result in an increase or decrease of lateral forces encountered at the drive handles 120 during propulsion and maneuvering of the floatation device 106. Optimum canted angles may be determined for specific applications. For example, but not by way of limitation, at canted angles greater than forty-five (45°) degrees, the displacement or movement of the drive handles 120 may be generally greater compared to the displacement or movement of the fins 140. Conversely, canted angles less than forty-five (45°) degrees may result in rapid and greater displacement or movement of the fins 140 compared to relatively less displacement or movement of the drive handles 120. A canted angle of less than forty-five (45°) degrees may require a user to apply greater force to move the drive handles 120 during propulsion of the floatation device 106.

Referring again to FIG. 1, a fin 140 may be connected to each of the canted journal blocks 110, 112. The fins 140 may include a generally rigid spine 142 and a generally flexible region 144. The fins 140 may comprise a substantially flat body that is thicker along their leading edge defined by the spine 142. The thickness of the fins 140 may gradually decrease from the spine 142 to a trailing edge 146. The stiffness or rigidity of the fins 140 is generally greater at the spine 142 and decreases toward the trailing edge 146. Combinations of different materials in the manufacture of the fins 140 or other manufacturing means may alter the stiffness characteristics of the fins 140.

Continuing now, the left and right drive handles 120 may be rotatably secured to the left and right canted journal blocks 110, 112. A foot strap 124 may connect the left and right drive handles 120. A portion 130 of the foot strap 124 may be fabricated of rigid material having opposite ends operatively connected to ball joints 126 and 128, respectively, for maintaining a constant distance between the ball joints 126, 128.

Figure 4:
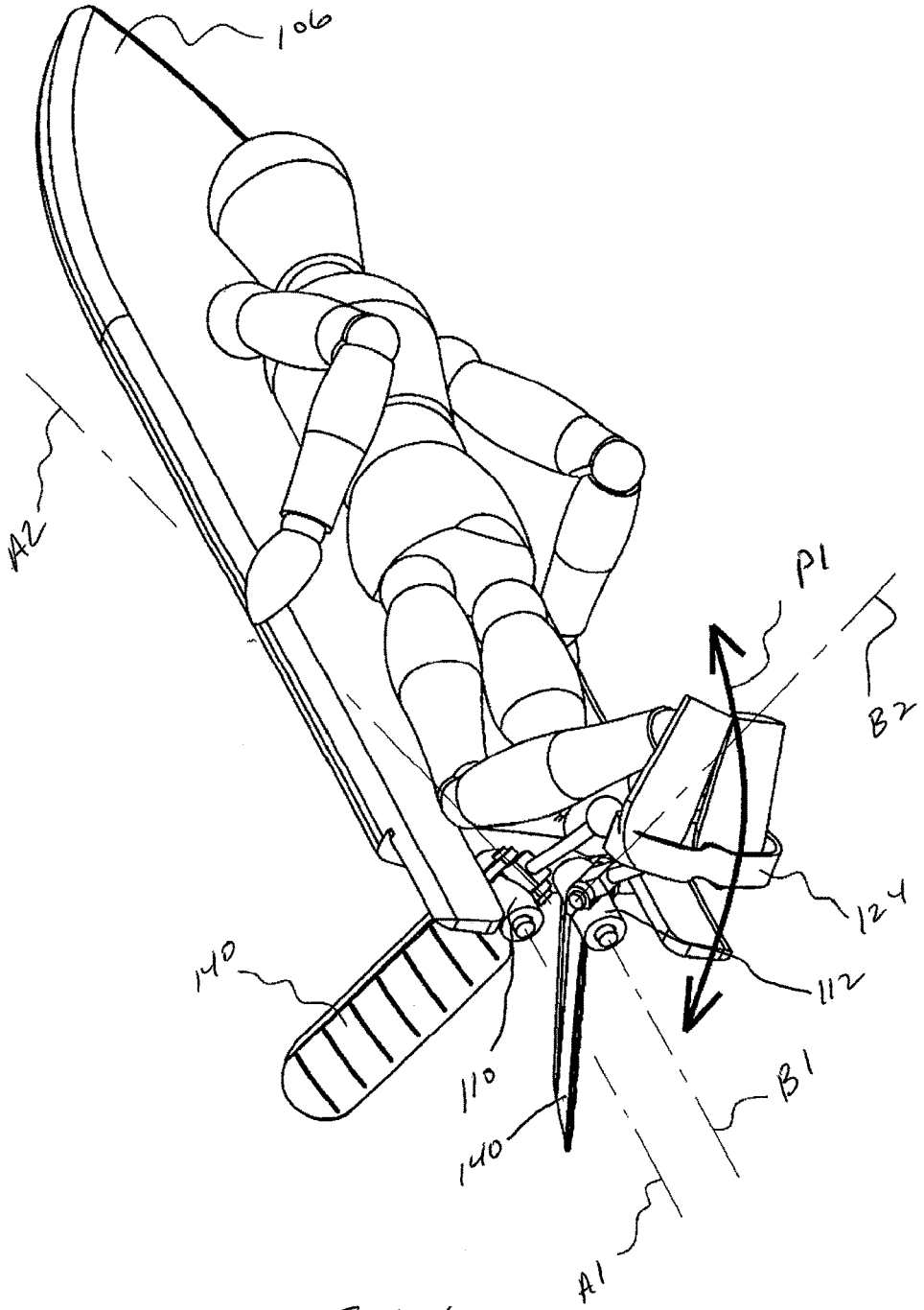
FIG. 4 is a perspective view of a user operating the oscillating fin propulsion assembly shown in FIG. 1.

Referring now to FIGS. 3A-3F, multiple positions of the fins 140 are illustrated upon movement by a user of the foot strap 124 to different positions and configurations. Movement of the foot strap 124 and consequently the drive handles 120, along a plane that is laterally centered with respect to the transverse center of the floatation device 106 and where the motion of the ball joints 126, 128 occurs in equal left and right arc paths P1 (illustrated in FIG. 4), results in the forward motion of the floatation device 106. Deviation of the arc paths P1 of the ball joints 126, 128 may result in thrust forces including both propulsion and maneuvering components. Thrust as well as maneuverability is possible depending upon the deviated arc paths (illustrated in FIG. 1 as P2 and P3) of the ball joints 126, 128, respectively. For example, but not by way of limitation, if a user reciprocates the drive handles 120 generally to the left, the floatation device 106 will yaw or turn right. In addition to yaw control, a user may change the direction that the floatation device 106 is pointing as well as rotate the floatation device 106 about a vertical axis. Roll control is also possible in the situation when a user may want to cause rotation about the center longitudinal axis of the floatation device 106 causing the left or right side of the floatation device 106 to rise out of the water. The efficiency of generating significant lateral thrust with the fins 140 combined with the efficiency of generating thrust in a forward direction, results in a fast and highly maneuverable floatation device 106.

It should be noted that the canted axis blocks 130, 132 may be molded identically (as illustrated throughout the drawings) where oscillation of the fins 150 ranges between ten and two o'clock positions when viewing a diver moving horizontally facing downwardly. However, for example, but not by way of limitation, where oscillation of the fins 150 may range between one and five o'clock positions, distinct and separately molded left and right canted axis blocks 130, 132 may be required, where the canted axes A2 and B2 of the canted axis blocks 130, 132 are identically oriented for the left and right sides of the propulsion apparatus, however, the bosses 154 may have a left side orientation and a right side orientation relative to the axes A1 and B1, respectively.

Referring now to FIGS. 5A-5C and FIG. 6, a second embodiment of an oscillating fin propulsion system is generally identified by the reference numeral 200. As indicated by the use of common reference numerals, the propulsion system 200 is similar to the propulsion assembly 100 described hereinabove with the exception that drive handles 120 include individual foot straps 224 fixedly secured to the upper distal ends of the drive handles 120. Providing independent control of the fins 140 may increase the complexity for the user in maneuvering the floatation device 106 but provides greater variations in the movements of the drive handles 120 and the fins 140. In may be noted that individual control of the drive handles 120 may require a user to manipulate the drive handles 120 laterally while propelling the floatation device 106 is a forward direction, thereby requiring greater user coordination and involve use of additional muscle groups.

Figure 5A:
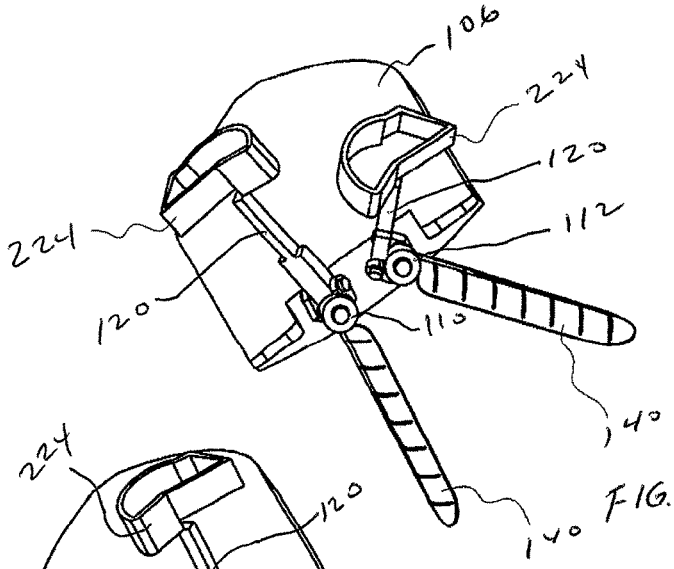
FIGS. 5A-5C are partially broken away perspective views of a second embodiment of an oscillating fin propulsion assembly mounted to a rear region of a floatation device.
Figure 5B:
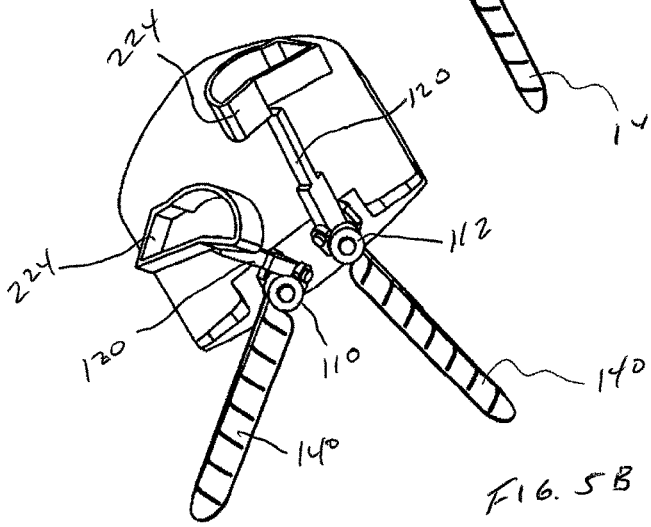
Figure 5C:
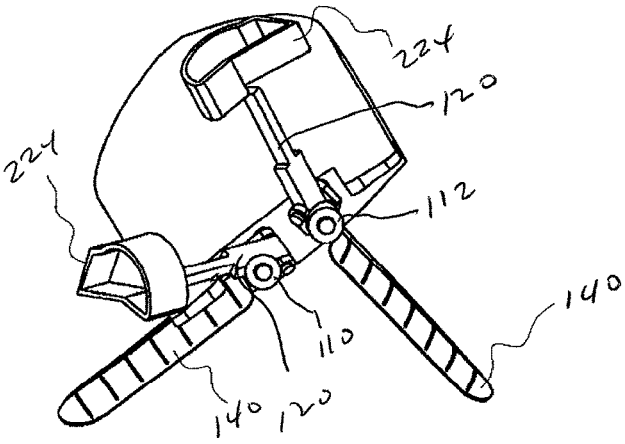
Figure 6:
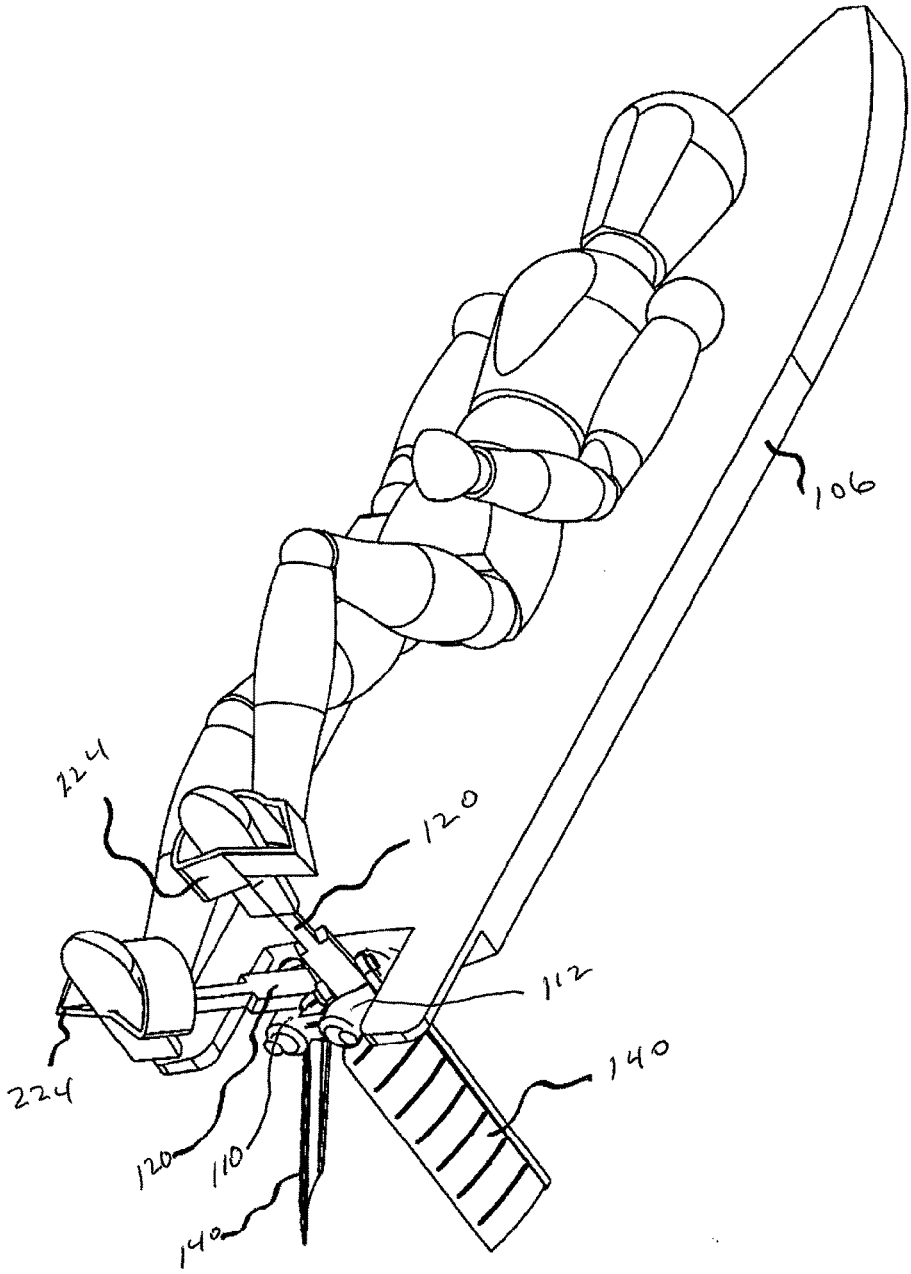
FIG. 6 is a perspective view of a user operating the oscillating fin propulsion assembly shown in FIGS. 5A-5G.

In FIGS. 5A-5C, perspective views are shown illustrating multiple positions of the fins 140 relative to the position of the drive handles 120 actuated by a user. In FIG. 6, a user lying on his back on a floatation device 106 is illustrated alternately and independently pushing and pulling the drive handles 120 to oscillate the fins 140 providing propulsion to move the floatation device 106 is a desired direction.

As described above with reference to the propulsion system 100, the canted journal blocks 110, 112 include two axes that are canted relative to each other. During normal operations of the oscillating fin propulsion systems described herein, axial and lateral forces acting on the canted journal blocks 110, 112 may be encountered that may require axial and radial load bushings, for example but not by way of limitation, flanged sleeve and/or conically shaped bearing bushings. UHMW, ceramic, graphite, or other non-metallic materials may be utilized in load bushing concentric with shafts 102, 104 providing interface surfaces between the shafts 102, 104 and the drive handles 120. Alternatively, metal such as phosphor bronze or stainless 440C may be utilized in such load bearings.

While several embodiments of oscillating fin propulsion apparatus have been shown and described herein, other and further embodiments of oscillating fin propulsion apparatus may be devised without departing from the basic scope thereof, and the scope thereof is determined by the claims which follow.

The invention claimed is:

1. A water propulsion assembly, comprising:

a) left and right canted journal blocks rotatably mounted on respective sides of a longitudinal axis of a floatation device, said left and right canted journal blocks including a borehole defining a first axis of a respective said left and right canted journal blocks;

b) left and right fins secured to a respective said left and right canted journal blocks;

c) left and right drive members rotatably connected to a respective said left and right canted journal blocks, said left and right drive members rotatable about a second axis of a respective said left and right canted journal blocks, wherein said second axis is canted relative to a respective said first axis; and d) wherein actuation of said left and right drive members oscillates said left and right fins transversely to the longitudinal axis of the floatation device.

2. The propulsion assembly of claim 1 wherein said second axis is canted at an angle between 10° to 80° relative to a respective said first axis.

3. The propulsion assembly of claim 1 wherein said second axis is canted at an angle of about 45° relative to a respective said first axis.

4. The propulsion assembly of claim 1 wherein actuation of said left and right drive members in a reciprocating motion transmits a torque force through said left and right canted journal blocks for oscillating said left and right fins transversely to the longitudinal axis of the floatation device through an arcuate path of up to 120°.

5. The propulsion assembly of claim 4 wherein said left and right drive members include elongated drive handles, said drive handles including transverse hollow tubes fixed at the lower distal ends of said drive handles and foot straps fixedly secured at the upper distal ends of said drive handles.

6. A mounting block for an oscillating water propulsion assembly, comprising:

a) a journal body having a longitudinal dimension;

b) a longitudinal borehole defining a first longitudinal axis of said journal body;

c) said journal body including a second longitudinal axis radially displaced from said first longitudinal axis, and wherein said second longitudinal axis is canted relative to said first longitudinal axis; and d) a fin pivotally connected to said journal body, said fin including a base coupled to said journal body concentric with said first axis of said journal body.

7. The mounting block of claim 6 wherein said second longitudinal axis is canted at an angle between 10° to 80° relative to a respective said first longitudinal axis.

8. The mounting block of claim 6 wherein said second longitudinal axis is canted at an angle of about 45° relative to a respective said first longitudinal axis.

* * * * *